United States Patent [19]

Matsumoto et al.

[11] 4,413,161

[45] Nov. 1, 1983

[54] ELECTRO-ACOUSTIC TRANSDUCER

[75] Inventors: Toyosaku Matsumoto; Takao Nakaya, both of Hamamatsu, Japan

[73] Assignee: Nippon Gakki Seizo Kabushiki Kaisha, Hamamatsu, Japan

[21] Appl. No.: 231,296

[22] Filed: Feb. 4, 1981

[30] Foreign Application Priority Data

Feb. 9, 1980 [JP] Japan ..... 55-15303[U]
Feb. 9, 1980 [JP] Japan ..... 55-15304[U]

[51] Int. Cl.[3] ..... H04R 9/02

[52] U.S. Cl. ..... 179/115.5 PV; 179/115.5 VC; 179/181 R

[58] Field of Search ..... 179/115.5 PV, 115.5 VC, 179/115.5 ME, 115.5 R, 119 R, 181 R

[56] References Cited

U.S. PATENT DOCUMENTS 3,919,498 11/1975 Palle-Finn Beer ..... 179/115.5 PV
4,242,541 12/1980 Ando ..... 179/115.5 PV X

*Primary Examiner*—Benjamin R. Fuller
*Attorney, Agent, or Firm*—Spensley, Horn, Jubas & Lubitz

[57] ABSTRACT

An electro-acoustic transducer comprises a planar type diaphragm having a circular voice coil formed on its surface and a magnet plate assigned for magnetically biasing said voice coil, said circular voice coil having a plurality of circular turns formed with a pattern that the respective circular turns of the circular coil are concentric to each other in at least one half portions of these turns. This arrangement of transducer makes its assembling or the positioning of the voice coil and the magnet plate extremely easy without degrading the output capability of the transducer.

20 Claims, 13 Drawing Figures

ELECTRO-ACOUSTIC TRANSDUCER

BACKGROUND OF THE INVENTION (a) Field of the Invention

The present invention relates to an electro-acoustic transducer of the so-called electro-dynamic type for use in, for example, loudspeakers, earphones and microphones, and more particularly it pertains to a planar type electro-acoustic transducer designed to impart a substantially uniform vibration to the entire areas of a vibratable diaphragm in case the present invention is applied to a loudspeaker and an earphone.

(b) Description of the Prior Art

As is known well, a basic structure of the so-called planar type electro-acoustic transducer, in general, is comprised of a vibratable diaphragm having a vibratable portion and a fixed stationary portion, a voice coil formed in the vibratable portion of the diaphragm, and a magnet plate having the formations of opposite magnetic poles on a surface thereof for applying to said voice coil such magnetic field as will ensure that the directions of the vector products thereof with the electric current flowing through the voice coil are rendered to be uniform in all parts of the voice coil. The magnet plate assembly has two types, one of which is comprised of two magnet plate members sandwiching the diaphragm therebetween while keeping appropriate air gaps between the surfaces of the respective magnet plates and the diaphragm carrying a coil on each side thereof. The other type comprises a magnet plate member disposed at a coil-carrying side of the diaphragm with an air gap therebetween. The former is called the push-pull type, and the latter is called the single type magnet plate assembly.

An example of a conventional planar type electro-acoustic transducer is shown in Japanese Utility Model Preliminary Publication No. Sho 51-100536, as shown in FIG. 1, which is comprised of a disk-shaped diaphragm 3 having thereon a voice coil formed with a helical winding of a bundle 2 of electric conductor 1 of a given length having at least two circular turns and a disk-shaped magnet plate 4. There is an advantage in this example that a powerful diaphragm-driving force can be obtained even when the interval between the opposite magnetic poles produced on the free surface of the magnet plate 4 is set relatively large as shown in FIG. 2, since a number of individual conductor strips through which electric current flows in a same direction are provided in the regions located between the respective opposite magnetic poles. Also, there is a further advantage that, owing to the fact that these strips of electric conductor are connected in series to each other, the impedance of this voice coil can be set at such a large value as is required for microphones and like devices.

In said conventional electro-acoustic transducer, however, there is a problem that the magnetic fluxes of the magnet no longer cross at right angle the signal-carrying electric current which flows through the voice coil even if the centers of the voice coil and the magnetic poles of the magnet plate have been registered precisely relative to each other, if there is present any slight positional misalignment in the circumferential direction of the helical pattern of the voice coil relative to the helical pattern of the magnetic poles when the disk-shaped diaphragm 3 and the disk-shaped magnet plate 4 are assembled together while paying attention to have these two members positioned so as to face each other properly. As a result, the efficiency of this electro-acoustic transducer drops markedly. That is, in case such electro-acoustic transducer is applied to a loudspeaker or an earphone, the transducer not only will exhibit a degradation of its output quality, but also would cause the generation of partial vibration of the planar type diaphragm. Also, in case such transducer is applied to a microphone, the induced electromotive force is partly cancelled out, so that the output of this transducer drops substantially. For these reasons, there has been required for an extremely precise positioning of the diaphragm and the magnet when they are assembled together into a complete transducer, and this has been a quite troublesome work and has led to an increase in the cost of manufacture.

SUMMARY OF THE INVENTION

It is, therefore, a general object of the present invention to provide an electro-acoustic transducer comprising: a voice coil formed on a diaphragm in such pattern that the coil portions thereof are concentric at least in one half portions of their circular turns of the helical pattern; and magnetic poles of a pattern similar to the coil pattern formed on a magnet plate so as to face said electric conductor, to thereby eliminate the above-mentioned drawbacks and inconveniences of the prior art.

A first object of the present invention is to provide an electro-acoustic transducer which does not give an adverse effect on the electro-acoustic transducing efficiency even where there is present some circumferential positional misalignment between the electric conductor formed on the diaphragm and the magnetic poles produced on the free surface of the magnet plate.

A second object of the present invention is to provide an electro-acoustic transducer in which, due to the absence of an adverse effect imparted onto the transducing efficiency even where there is present some circumferential misalignment in the positional relationship between the diaphragm and the magnet plate, the construction efficiency of the transducer is improved and concurrently the yield of production of the transducers is markedly enhanced.

A third object of the present invention is to provide an electro-acoustic transducer which provides for a large output due to the precise positional correspondence between the pattern of the voice coil and pattern of the magnetic poles of the magnet plate.

A fourth object of the present invention is to provide an electro-acoustic transducer which is provided with a voice coil prepared by the use of a coil-forming single conductor wire or a coil-forming bundle of a plurality of conductive wires which is bent into adjacently running continuous two conductive wires or adjacently running continuous two bundles of conductive wires, and by arranging such coil-forming conductor into a continuous helical shape having plural circular turns such that at least one halves of respective these circular turns are concentric relative to each other.

A fifth object of the present invention is to provide an electro-acoustic transducer which is provided with a voice coil having such a pattern that a coil-forming conductive single wire or a coil-forming bundle of conductive wires is bent into adjacently but oppositely running continuous double wires or continuous double bundles which are turned into a substantially circular shape so that the major portions of the respective turned portions of the conductor are concentric relative to each other.

A sixth object of the present invention is to provide an electro-acoustic transducer in which a voice coil as well as electrodes which are formed at both terminals of the voice coil are positioned on a same side of a diaphragm and this arrangement is formed altogether by relying on photo-etching.

DETAILED DESCRIPTION OF THE PREFERRED EMBODIMENTS

The present invention will hereunder be described with respect to some preferred embodiments thereof by referring to the accompanying drawings.

Figure 3:
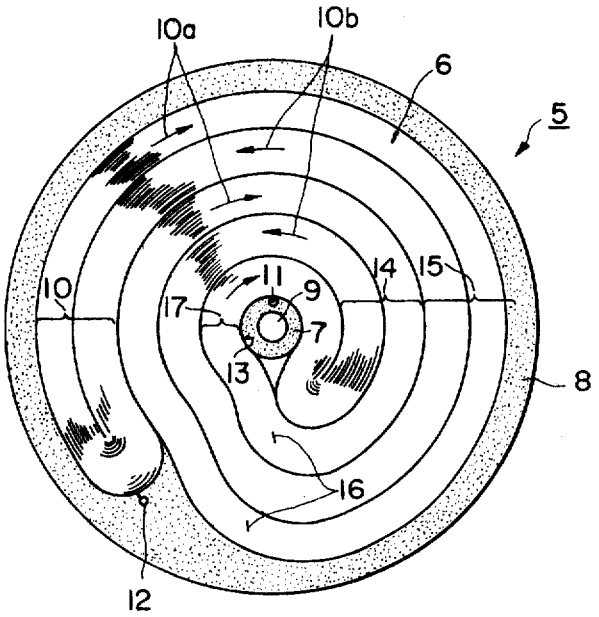
FIG. 3 is a diagrammatic plan view of a diaphragm provided with a voice coil having a pattern representing a first embodiment of the present invention.

FIG. 3 shows a first embodiment of the diaphragm which is used in an electro-acoustic transducer. As shown, a diaphragm 5 is formed with a non-magnetizable, non-electroconductive flexible disk-like thin plate made of, for example, a polyester sheet and is provided, on one side thereof by relying on such technique as photo-etching, with a voice coil 6, an inner circumferential pattern electrode 7 and an outer circumferential pattern electrode 8 both of which electrodes are formed in required patterns and are electrically connected to the respective terminals of said voice coil 6.

Hereunder will be described in further detail the above said inner as well as the outer circumferential patterns. The diaphragm 5 is provided centrally thereof witha through-hole 9 for the insertion therethrough of an electroconductive eyelet member which will be described later. Along the circumference which defines the through-hole 9, there is formed the electroconductive inner circumferential pattern electrode 7 of a ring shape having an appropriate width. Also, along the outer circumferential marginal edge of the diaphragm 5, there is formed the electroconductive outer circumferential pattern electrode 8 of a ring shape having a required width.

On the other hand, the pattern of the voice coil 6 will be expressed metaphorically hereunder by assuming that it is formed by the use of a single electroconductive wire or strip. Initially, a conductor which may be either a wire or a strip in shape is wound into a helical pattern of at least two turns in a same plane to thereby form a planar type circular coil. Then, the substantial circle which is given by the circular coil is pulled diametrically to form a flat bundle 10 of coil comprising adjacently running doubled wires or strips which are continuous to each other. This flat ribbon-like bundle 10 of coil is arranged so that the starting end 11 of winding of the circular coil, i.e. the end which is to be positioned at the innermost circumference of the diaphragm, is located at one end of the bundle 10 of coil, whereas the trailing end 12 of said winding, i.e. the end which is to be positioned at the outermost circumference of the diaphragm, is located at the other end of the circular coil.

Then, the ribbon-like flat bundle 10 of coil is wound into a helical pattern starting at the central portion of the disk-like diaphragm 5, and, with the exception of the bent portion of the bundle which serves as the transitional portion of the turns for the adjacently running concentric bundles, the doubled bundles are wound into substantially concentric circles as shown in FIG. 3. More particularly, in this embodiment, one bent end portion 11 of the flat doubled bundle 10 of coil which is to be located near the central portion of the diaphragm is opened apart into nearly a ring shape 13 to such extent enough to substantially encompass the major portion of the inner circumferential pattern electrode 7. Thus, this starting portion of the flat bundle 10 of coil is positioned so that said inner circumferential pattern electrode 7 is accomodated within said ring shape 13 of the bundle of coil 10. Concurrently therewith, said starting end 11 of the winding is electrically connected to the inner circumferential pattern electrode 7.

Figure 1:
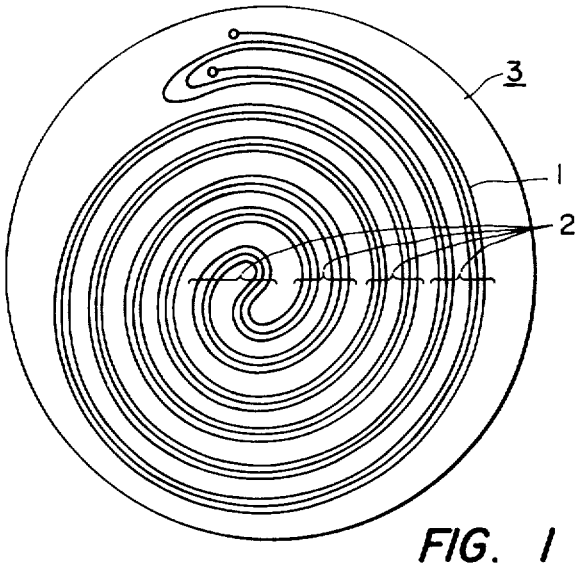
FIG. 1 PRIOR ART
FIG. 1 is a diagrammatic plan view of a known diaphragm provided with a voice coil having a helical pattern.
Figure 2:
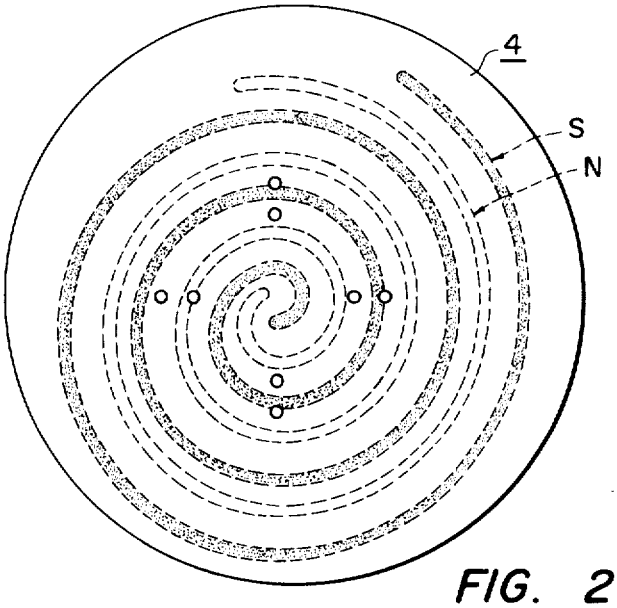
FIG. 2 PRIOR ART
FIG. 2 is a diagrammatic plan view of a known magnet plate having a pattern of magnetic poles corresponding to the helical pattern of the voice coil shown in FIG. 1.

Then, with said starting end 11 serving as the starting point, the flat bundle 10 of coil is wound progressively into a close circular shape along the external circumference of said starting end portion 11 which forms the above said ring shape 13. The greatest feature of this embodiment lies in the pattern of winding referred to above. That is, in the case of the known diaphragm shown in FIG. 1, the conductor wire or strip is wound in an ordinary helical pattern, wherein the radius of curvature of each helical turn increases progressively as the turn goes from the central portion toward the outer turns. In contrast thereto, the pattern exhibited by the first embodiment shown in FIG. 3 is such that the first turn 14 and the second turn 15 each presents a configuration of a substantially true circle excepting the transitional portion of the turns located between the first turn and the second turn. Besides, the first and second turns are concentric relative to the through-hole 9. Furthermore, the initial zero turn 17 also presents a substantially true-circular configuration and is concentric relative to the first turn 14 and to the second turn 15. The end 12 of winding of the flat bundle 10 of coil is electrically connected to the outer circumferential pattern electrode 8. As stated previously, this pattern of the voice coil is formed, in practice, by relying on such technique as photoetching.

Figure 4:
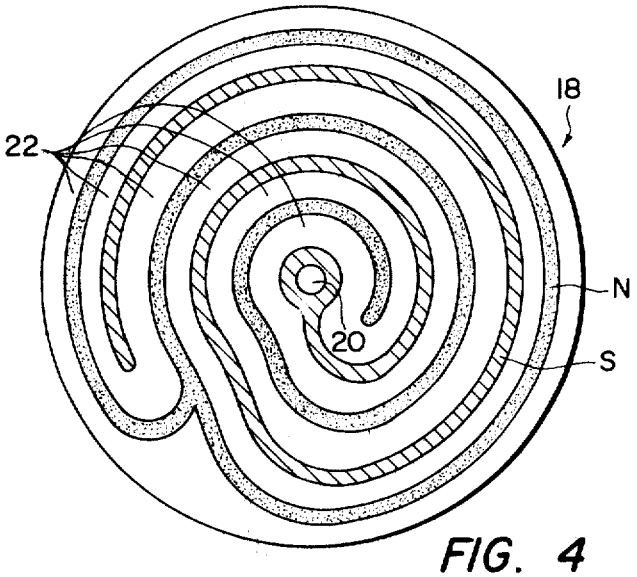
FIG. 4 is a diagrammatic plan view of a magnet plate having a pattern of magnetic poles corresponding to the rear-view pattern of the voice coil shown in FIG. 3.
Figure 5:
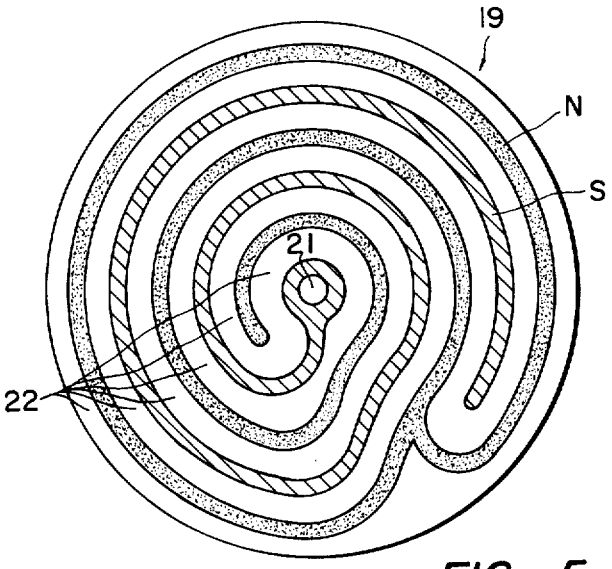
FIG. 5 is a diagrammatic plan view of a magnet plate having a pattern of magnetic poles corresponding to the front-view pattern of the voice coil shown in FIG. 3.

On the other hand, the magnet plates 18 and 19 which are provided on the front and rear sides of the diaphragm 5, one for each side, with the intervention of an air gap between each magnet plate and the diaphragm, are constructed as shown in FIGS. 4 and 5.

More particularly, both magnet plates 18 and 19 each corresponds to the size of the diaphragm 5, and these disk-like magnet plates 18 and 19 having central through-holes 20 and 21, respectively, have their surfaces magnetized to provide an S pole and an N pole of required patterns as shown. These patterns of the S pole and the N pole are formed so as to correspond to the pattern of the voice coil 6 provided on the diaphragm 5. More particularly, the patterns of the magnetic poles are arranged in such way that the N pole and the S pole are formed alternately in the radial direction of the diaphragm 5 in correspondence to the positions of the adjacently located respective edge lines of both the conductor bundle 10*a* through which an electric current is to flow in a certain direction and the conductor bundle 10*b* through which an electric current is to flow in a direction opposite to said certain direction, which bundles 10*a* and 10*b* jointly constitute each flat bundle 10 of coil provided on each side of the diaphragm 5. Here again, the first turn 14 and the second turn 15 which jointly constitute the voice coil 6 as stated previously are each arranged in such pattern as to present a substantially true circle with the exception of the transitional portions 16 of the turns assigned for connecting these two turns 14 and 15 together. Besides, these two turns are of a concentric relation with each other. Therefore, those portions, corresponding to the true circle portions of the voice coil pattern, of the patterns of the S pole and the N pole which are developed on the respective surfaces of the magnet plates 18 and 19 each presents a substantially true circle, and accordingly these portions are concentric to each other. It should be understood that the patterns of the magnetic poles provided on the magnet plate 18 correspond to that pattern of the voice coil 6 which is viewed at the rear side of this coil formed on the diaphragm 5. Reference numeral 22 represents a transitional zone of magnetic poles for defining an interval or space between adjacent respective magnetic poles. Upon completion of the assembling of a transducer, the respective transitional zones are confronted by the respective turns of the voice coil 6. Either one or both of the diaphragm and the magnet plate may have perforations formed therethrough for the purpose of, for example, transmitting the vibrating air therethrough. Further, the diaphragm usually has a single coil on either side surface thereof even in the push-pull type while it may provide two coils on the both sides in such type.

Figure 6:
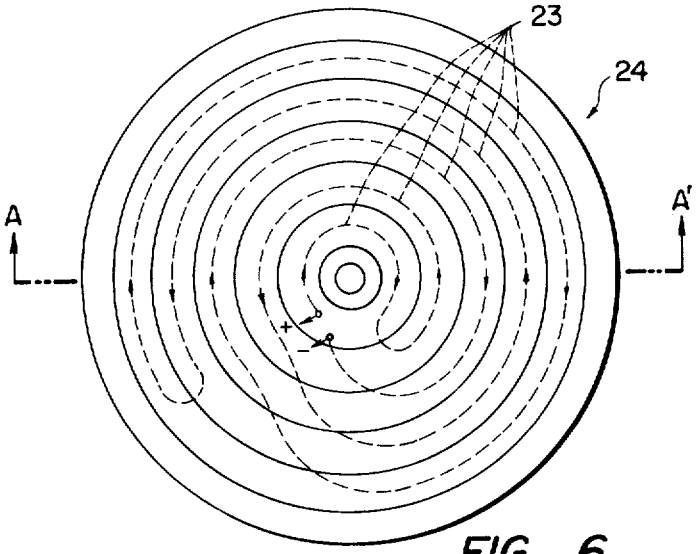
FIG. 6 is a diagrammatic plan view of a magnetizer structure for use in the manufacture of the magnet plates shown in FIGS. 4 and 5.
Figure 7:
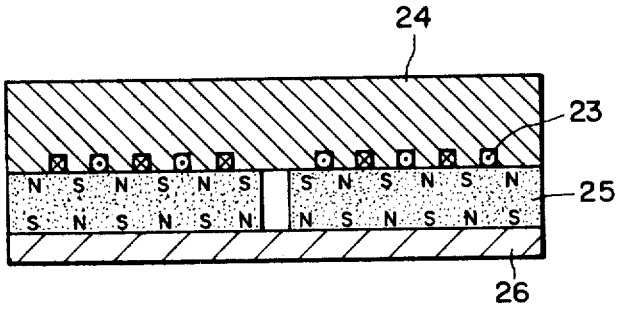
FIG. 7 is a diagrammatic sectional view taken along the line A—A' in FIG. 6.

In order to manufacture the magnet plates 18 and 19 having such magnetic pole patterns as described above, there is used, for example, a magnetizer 24 containing therein a buried magnetizing coil 23 of such pattern as shown in FIGS. 6 and 7. And, as shown in FIG. 7, this magnetizer 24 is placed closely onto a magnetizable plate 25 which requires to be magnetized. Concurrently therewith, a yoke plate 26 is caused to adhere to the opposite side of the magnetizable plate 25. Then, a magnetizing electric current may be applied to flow through the magnetizing coil 23.

Figure 8:
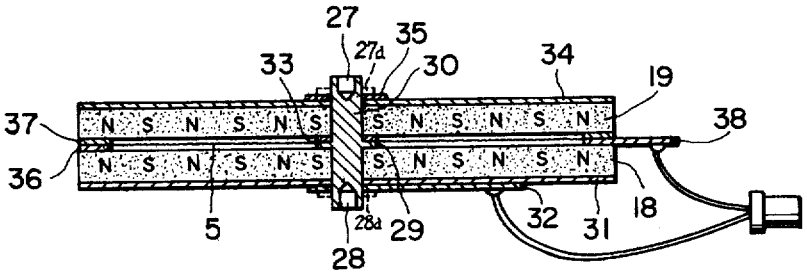
FIG. 8 is a diagrammatic sectional view showing the assembled state of an electro-acoustic transducer provided with a diaphragm and a magnet plate representing the first embodiment of the present invention.

On the other hand, in order to assemble the transducer, there is employed, for example, an electroconductive tubular eyelet member 30 having blind holes 27 and 28 at both ends thereof and having a flange 29 formed at an intermediate portion of this member 30 as shown in FIG. 8. An annular electrode ring 36, a magnet plate 18, a yoke plate 31 and an electrode terminal member 32 are fitted onto the eyelet member 30 in this order at one end thereof. A diaphragm 5, an annular outer circumferential spacer 37, an inner circumferential spacer 33, a magnet plate 19, a yoke plate 34 and a washer 35 are fitted onto the eyelet member 30 in this order at the other end thereof. Finally, the peripheral walls of both blind holes 27 and 28 are opened outwardly as shown by imaginary lines 27*a* and 28*a* to caulk the eyelet member 30.

Thus, the diaphragm 5 is securely nipped at its central portion by the cooperation of the inner circumferential spacer 33 and the flange 29. Also, the circumferential marginal edge portion of the diaphragm 5 is securely nipped by both the electrode ring 36 which is secured to the magnet plate 18 side and the outer circumferential spacer 37 which is secured to the magnet plate 19 side. In case the diaphragm 5 is applied to a microphone, there is derived, via the electrode terminal member 32 and an electrode terminal member 38 protruding from the electrode ring 36, a voltage induced in the voice coil 6. Also, in case the diaphragm 5 is applied to a loudspeaker or an earphone, there is supplied a signal-carrying electric current to the voice coil 6.

It will be apparent from the foregoing description that, in an electro-acoustic transducer according to the first embodiment of the present invention, the presence of some positional misalignment, in the circumferential direction, between the circular patterns of the voice coil 6 which are formed on the diaphragm 5 and the circular patterns of the magnetic poles formed on the surfaces of the magnet plates 18 and 19 at the time the transducer is assembled will give hardly any adverse effect on the electro-acoustic transducing efficiency, and thus the yield of production of the transducer is markedly improved.

More specifically, both the circular portion of each turn of the voice coil 6 and the circular portion of each turn of the magnetic poles are formed so as to present a substantially true circle excepting only those transitional portions 16 of the turns located between one turn and the adjacent next turn of these helical patterns. Moreover, these respective circular portions are in concentric relation relative to each other. Accordingly, even if there is present some positional misalignment in the circumferential direction of the diaphragm between the pattern of the voice coil formed on the diaphragm and the patterns of the magnetic poles formed on the magnet plates, it should be noted that the variation of the angle formed between the direction of the electric current flowing through the voice coil and the magnetic fluxes developed by the magnet plates owing to such misalignment will take place only at said transitional portions 16. In the remaining major portions, however, both circular portions face each other correctly so that the angle formed between the current flowing through the voice coil and the magnetic fluxes is still maintained at right angle. As a result, the electro-acoustic transducing efficiency of the final products will hardly be lowered.

Also, the electro-acoustic transducer described above is of the arrangement that its voice coil pattern and magnet plate pattern are formed in exact correspondence to each other to ensure that the coil, in all of its portions, crosses the magnetic fluxes at right angle when properly assembled. For this reason, as compared with the arrangement where the voice coil has a spiral configuration and the magnet plates are formed in patterns of a concentric circle, the transducer of this instant embodiment is capable of deriving a large output.

Furthermore, the above-mentioned embodiment makes it possible to accomplish the connection of those electrode members 29 and 36 provided at the central portion and at the peripheral marginal portion of the diaphragm to the respective terminals 11 and 12 of the voice coil on a same plane by relying on the photo-etching technique. It should be noted here that said electrode member 29 is an innermost one, which is provided in the form of a flange of the eyelet member 30 in FIG. 8. Thus, the lead-out structure at the terminals of the voice coil can be remarkably simplified. Not only that, but this lead-out structure will give no influence whatsoever to the vibrations exerted by the diaphragm 5.

Figure 9:
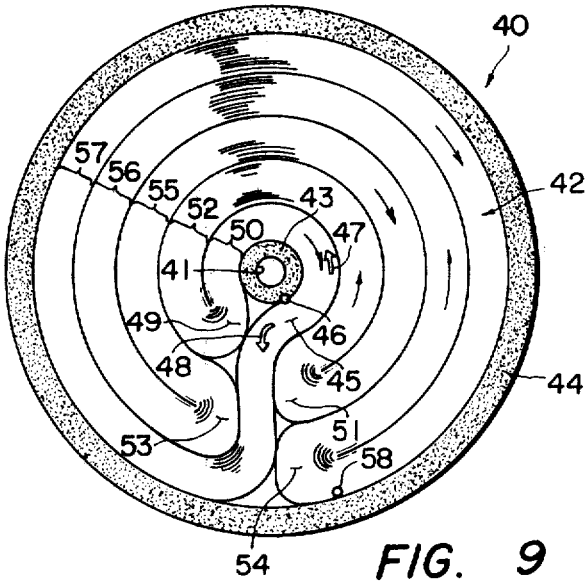
FIG. 9 is a diagrammatic plan view of a diaphragm provided with a voice coil having the pattern representing a second embodiment of the present invention.

FIG. 9 shows a second embodiment of the diaphragm. This diaphragm 40 is similar to that of the first embodiment in that, as shown, it has a central through-hole 41 and a voice coil formation 42 and an innermost electrode 43 as well as an outermost electrode 44 both of which are electrically connected to the starting end and the terminal end of the voice coil 42, respectively, and that all of these members are provided in required patterns and formed by relying on, for example, the photo-etching technique on a surface of a non-magnetizable, non-electroconductive, flexible disk-like thin plate made of, for example, a polyester sheet.

The diaphragm 40 of this embodiment, however, differs from that of the preceding embodiment in the pattern of the voice coil 42. This pattern will be metaphorically expressed in the same way as for the preceding embodiment, as follows.

An electroconductive wire or ribbon-like strip is arranged to form a circular coil having at least two circular turns on a single plane. Then, an arbitrary point 45 of the circular turns of the coil is positioned at substantially the central region of the diaphragm 40 while positioning the innermost electrode 43 at the innermost site of the circular turns of the coil. Also, the starting end 46 of the coil is set at substantially the central portion of the diaphragm 40. And, one extension 47 of the bifurcated extensions 47 and 48 of the coil leading from said point 45 is wound counter-clockwise in the shape of a substantially true circle around the center of the diaphragm 40. Then, a bent corner portion 49 of the extension 47 is wound along a first circular turn 50 in a reverse direction for about one whole circular turn into a substantially true circle, and again at another corner portion 51, the extension 47 is reversed in the direction of its turn and wound along the second circular turn 52 for about one whole true circular turn. Thereafter, the above-mentioned steps are repeated at the bent corners 53 and 54 to form circular turns 55 to 57. The outermost circular turn 57 is coupled or merged to the other extension 48 of the coil portion. Then, the end 58 of winding of this coil is positioned at an outer circumferential portion of the diaphragm 40. By so arranging the voice coil 42, the latter is formed into such pattern of winding comprising a plurality of concentric circular turns 50, 52, and 55 to 57 which are present for over one half circles.

Figure 10:
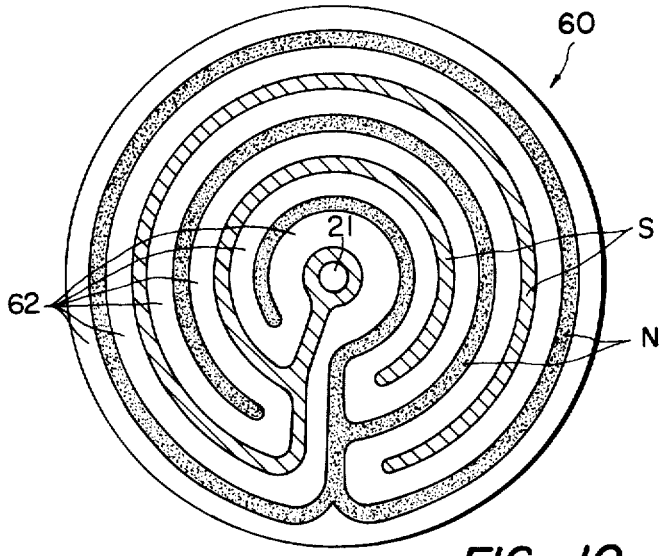
FIG. 10 is a diagrammatic plan view of a magnet plate having a pattern of magnetic poles corresponding to the rear-view pattern of the voice coil shown in FIG. 9.
Figure 11:
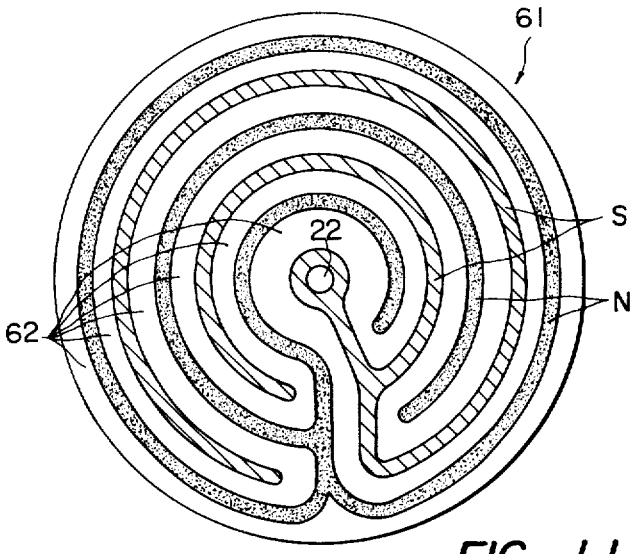
FIG. 11 is a diagrammatic plan view of a magnet plate having a pattern of magnetic poles corresponding to the front-view pattern of the voice coil shown in FIG. 9.

On the other hand, the respective magnet plates 60 and 61 which are provided on both sides of the diaphragm 40 with the intervention of an air gap respectively therebetween are, as shown in FIGS. 10 and 11, such that S pole patterns and N pole patterns are formed in correspondence to the positions of the boundary lines between adjacently running current paths, i.e. 50, 55 and 57 for the passage of current in a certain direction, and to the positions of the boundary lines between adjacently running current paths 52 and 56 for the passage of current in an opposite direction.

In this embodiment also, the first to the fifth circular turns 50, 52, and 55 to 57 which jointly constitute a voice coil 40 are formed into such patterns as will form a substantially true circle, respectively, excepting their bent corner portions 49, 51, 53 and 54. Moreover, these circular turns 50, 52, and 55 to 57 are concentric relative to the through-hole 41. Accordingly, with respect also to the patterns of the S pole and the N pole which are formed on the surface of each of the magnet plates 60 and 61, those portions thereof corresponding to the substantially true circles of the voice coil are rendered to substantially true circles in shape, and these portions are in a concentric relations to each other. Reference numeral 62 represents a transitional zone for defining the interval of space between adjacent magnetic poles.

In this second embodiment, an arbitrary point 45 on the circumference presented by the circular coil is positioned at the central region of the diaphragm 40. Among the bifurcated extensions 47 and 48 of the coil which extend in two ways starting at said point 45, only the extension 47 of them is used to form a plurality of circular turns 50, 52, 55, 56 and 57. Therefore, the areas of the coil occupied by the bent corner portions can be reduced extremely so that it is possible to increase to a maximum extent the lengths of those circumferences of coil occupied by the respective true circular turns 50, 52, 55 and 57.

Figure 12:
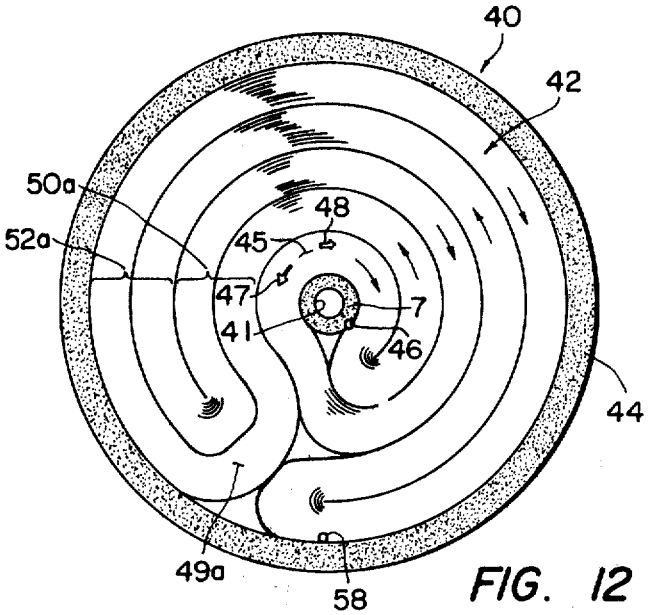
FIG. 12 is a diagrammatic plan view of a diaphragm provided with a voice coil having a pattern representing a third embodiment of the present invention.

FIG. 12 shows a third embodiment. In this embodiment, both of the bifurcated extensions 47 and 48 extending in two ways at point 45 of the coil are placed together into adjacently running doubled strips of conductor, and the resulting doubled pair is wound for substantially one whole turn into a substantially true circle about the central point of the diaphragm 40. Then, the turn is reversed in its direction at point **49*a*, and is wound for about one whole turn into a substantially true circle along the first circular turn 50*a* to form a second circular turn, whereby providing the specific pattern of this embodiment. In this third embodiment also, it should be understood that, with respect to the positional misalignment in the circumferential direction between the coil pattern and the magnetic pole pattern caused at the time of assembling the transducer, a same assurance as that for the preceding embodiments for the action of the transducer can be enjoyed. In FIG. 12**, like reference numerals are used to indicate same parts of the first embodiment, and alphabetical letters are attached to like parts to omit their explanation.

Figure 13:
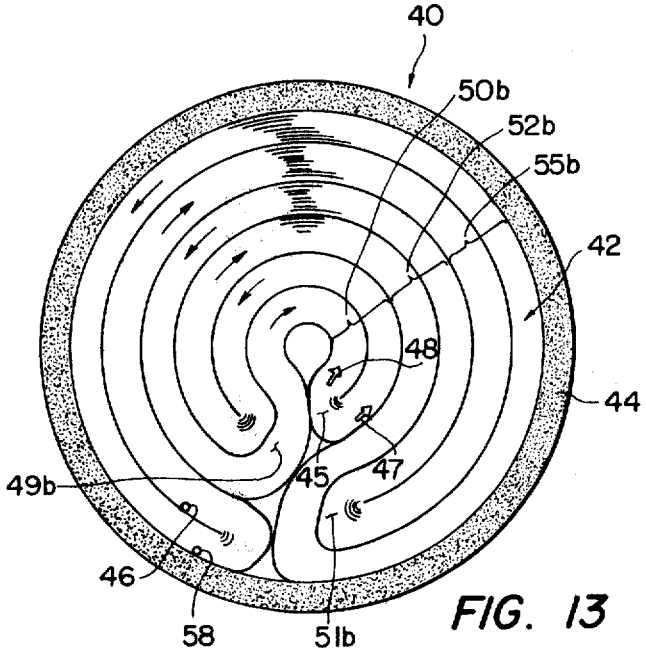
FIG. 13 is a diagrammatic plan view of a diaphragm provided with a voice coil having a pattern representing a fourth embodiment of the present invention arranged so that the diaphragm is secured only at its marginal portions to an anchoring member.

Furthermore, the first to the third embodiments are pointed to electro-acoustic transducer invariably employing a diaphragm which is secured to a frame at its central as well as peripheral marginal edge portions. It should be understood, however, that the present invention can be applied equally effectively to such electro-acoustic transducer structure as shown in the fourth embodiment illustrated in FIG. 13 wherein the diaphragm 40 is secured only at its outer marginal portion. In such case, it is only necessary to arrange that the starting end 46 of the coil and the winding end 58 thereof are both disposed at the outer marginal portion of the diaphragm 40, and that output terminals may be led out separately from the front side and the rear side of the diaphragm 40.

Also, the second to the fourth embodiments described above, needless to say, are such that the coil pattern and the magnet plate pattern are in accurate correspondence to each other as in the instance of the first embodiment, so that there is the advantage that a large output can be obtained.

What is claimed is:

1. An electro-acoustic transducer, comprising:

a diaphragm made of a non-magnetizable, non-electroconductive flexible planar material having a vibratable portion and a stationary portion;

a continuous circular coil made of electrically conductive material formed on a surface of said diaphragm and having a plurality of turns, wherein at least one half of each turn is circular and concentric with the other turns; and a magnet plate having a pair of opposite magnetic poles formed on its surface with a pattern corresponding in its entirety to the pattern of said coil, said opposite magnetic poles being disposed alternately in radial direction of said magnet plate while forming transitional zones between adjacent opposite magnetic poles, said magnet plate being positioned with respect to the diaphragm so that said transitional zones are confronted by respective turns of the coil, said stationary portion of the diaphragm being fixed relative to said magnet plate.

2. An electro-acoustic transducer according to claim 1, in which the turns of said circular coil are formed in such a pattern as to ensure that a direction of an electric current flowing through one turn of the coil is opposite to that of an electric current flowing through a turn of the coil running adjacent to said one turn.

3. An electro-acoustic transducer according to claim 2, in which said coil has a circular pattern formed by turns of a bundle of a pair of said coil, said turns being concentric to each other in at least their one half portions of each circular turn.

4. An electro-acoustic transducer according to claim 1, in which said circular turns of the coil has the pattern that the respective turns are concentric to each other excepting those portions thereof which connect adjacent runs of the turns respectively.

5. An electro-acoustic transducer according to claim 4, in which said magnetic poles on the magnet plate has the pattern in which each pole forms circular turns concentric to each other excepting those portions thereof which connect adjacent runs of the same pole turns respectively.

6. An electro-acoustic transducer according to claim 3, in which said circular pattern is one formed from a bundle of a pair of runs of said coil, wherein said bundle is formed into a circular pattern staring at substantially the center of said diaphragm in such way that the resulting turns are circular and concentric to each other except for those portions thereof which connect adjacent turns of said bundle together, respectively.

7. An electro-acoustic transducer according to claim 2, in which said coil has a pattern formed by reversing the run of said circular coil a plurality of times to provide concentric circular runs throughout substantially the entire region of the circular runs.

8. An electro-acoustic transducer according to claim 7, in which said pattern of a plurality of reversed turns of coil begins at an arbitrary point of said circular coil at substantially the center of said diaphragm, wherein a pair of runs of the coil extend in different directions from the arbitrary point, and wherein:

at least one of the runs of coil extends from said point for about one whole circular turn into a substantially true circle about the center of the diaphragm to thereby form a first circular turn;

the direction of run of coil reverses so as to run concentrically along said first circular turn for about one whole circular turn to thereby form a second circular turn; and the run of coil again reverses so as to run concentrically along said second circular turn for about one whole circular turn to thereby form a third circular turn.

9. An electro-acoustic transducer according to claim 7, in which said pattern of a plurality of reversed turns of coil begins at an arbitrary point of said circular coil at substantially the center of said diaphragm, wherein a pair of runs of the coil extend in different directions from the arbitrary point, and wherein:

a first one of the runs of coil extends from said point for about one whole circular turn into a substantially true circle about the center of the diaphragm to thereby form a first circular turn of a single run of coil;

the direction of the first run of coil then reverses so as to run concentrically along said first circular turn for about one whole circular turn to thereby form a second circular turn of a single run of coil;

the first run of coil then again reverses so as to concentrically run along said second circular turn for about one whole circular turn to thereby form a third circular turn of a single run of coil; and a second one of the runs of coil extending from the arbitrary point is connected to the first run at a resulting outermost circular turn thus formed.

10. An electro-acoustic transducer according to claim 7, in which said pattern of a plurality of reversed turns of coil begins at an arbitrary point of said circular coil at substantially the center of said diaphragm, wherein a pair of runs of the coil extend in different directions from the arbitrary point, and wherein:

each of the runs which extend in two directions from said arbitrary point extends about the center of the diaphragm and meets the other run to form adjacently running doubled runs of coil, the resulting doubled adjacent runs of coil extending from about one whole circular turn into a substantially true circle about the center of the diaphragm to thereby form a first circular turn of doubled runs of coil;

the direction of run of the doubled runs of coil reverses so as to run concentrically along said first circular turn for about one whole circular turn to thereby form a second circular turn of doubled runs of coil; and the run of doubled coil again reversed as to concentrically run along said second circular turn for about one whole circular turn to thereby form a third circular turn of doubled runs of coil.

11. An electro-acoustic transducer according to claim 2, in which said opposite magnetic poles are formed such that an N pole is formed on a surface of said magnet plate at a site corresponding to each boundary defined by respective first adjacent turns of coil, and that an S pole is formed on said surface of the magnet plate at a site corresponding to each boundary defined by respective second adjacent turns of coil located next to said first adjacent turns, and the transitional zone is formed between the N and S pole, respectively.

12. An electro-acoustic transducer according to claim 1, in which:

the diaphragm has a central through-hole and said stationary portion of said diaphragm is formed both at an outer marginal edge portion of the diaphragm and also at an innermost peripheral edge portion of the diaphragm defined by the central through-hole, wherein both of said outer and inner stationary portions have electrodes, respectively, formed on the same surface thereof, said continuous circular coil is formed on the same surface of the diaphragm as the electrodes and has a starting end and a terminal end of winding, one of said ends being electrically connected to the electrode provided at the outer stationary portion of the diaphragm, and the other being electrically connected to the electrode formed at the inner stationary portion of the diaphragm, said magnet plate comprises two members with one on one side of said diaphragm and spaced from the diaphragm by said electrode disposed at the inner and outer stationary portions of the diaphragm and the other on the other side of the diaphragm and spaced from the diaphragm by an inner and an outer circumferential spacer, and said two magnet plate members are each provided with a through-hole corresponding to said through-hole of the diaphragm.

13. An electro-acoustic transducer according to claim 12, in which each of said magnet plate members has a pattern of magnetic poles formed on that side facing the diaphragm, and has a yoke plate adhering to its other side.

14. An electro-acoustic transducer according to claim 12, in which said diaphragm is fixed by an electroconductive eyelet member fitted through said central through-hole of the diaphragm while leaving an appropriate air gap on each side of the diaphragm, and said electrode provided at the inner stationary portion of the diaphragm is electrically connected to said conductive eyelet member.

15. An electro-acoustic transducer according to claim 2, in which:

the coil has a starting end and a terminal end, said stationary portion of the diaphragm is formed only at its outer marginal edge portion, said transducer including first and second electrodes formed on opposite sides of said outer marginal edge portion of the diaphragm, one on each side, and one of said starting end and terminal end of said circular coil is connected to the first electrode and the other end is connected to the second electrode.

16. An electro-acoustic transducer according to claim 1, in which said circular coil is of a flat configuration parallel with the surface of said diaphragm.

17. An electro-acoustic transducer according to claim 16, in which said flat circular coil is formed on one side of said diaphragm by relying on a photoetching technique.

18. An electro-acoustic transducer according to claim 12, in which said electrodes provided on the same surface of the diaphragm at the inner peripheral portion and the outer marginal edge portion of the non-vibratable portions of the diaphragm, and the circular coil provided on the vibratable portion of the diaphragm on said same surface thereof are all formed by relying on a photoetching technique.

19. An electro-acoustic transducer, comprising:

a diaphragm made of a flexible planar material;

a circular coil of conductive material formed on a surface of the diaphragm, said coil having a plurality of turns, wherein the coil has a first sector including runs in which each turn is circular and concentric with the other turns, and a second sector including runs which interconnect turns of the first sector;

a magnet plate located in facing relation to the diaphragm, said magnet plate including a pair of opposite magnetic poles formed on its surface, wherein the pattern of magnetic poles includes a first part corresponding to the pattern of the first sector of the coil and a second part corresponding to the pattern of second sector of the coil.

20. A transducer according to claim 19 wherein the first sector covers at least approximately three quarters of the surface of the circular coil.

* * * * *